US005279468A

United States Patent [19]

Küster

[11] Patent Number: 5,279,468

[45] Date of Patent: Jan. 18, 1994

[54] BOWDEN-CABLE WINDOW-LIFTER DRIVE FOR VEHICLES

[75] Inventor: Klaus Küster, Ehringshausen, Fed. Rep. of Germany

[73] Assignee: Kuester & Co., GmbH, Ehringshausen, Fed. Rep. of Germany

[21] Appl. No.: 747,329

[22] Filed: Aug. 19, 1991

[51] Int. Cl.[5] ..... B65H 75/34; E05F 11/48

[52] U.S. Cl. ..... 242/54 R; 49/352; 74/505

[58] Field of Search ..... 242/54 R, 49/349, 352, 49/353; 74/501.5 R, 505, 506

[56] References Cited

U.S. PATENT DOCUMENTS 4,306,378 12/1981 Fukura et al. ..... 49/352
4,628,759 12/1986 Kobayashi et al. ..... 242/54 R

FOREIGN PATENT DOCUMENTS 1252557 10/1967 Fed. Rep. of Germany .
1928185 2/1970 Fed. Rep. of Germany .
7735750 3/1978 Fed. Rep. of Germany .
3325837 2/1985 Fed. Rep. of Germany .

*Primary Examiner*—John M. Jillions
*Attorney, Agent, or Firm*—Longacre & White

[57] ABSTRACT

A bowden-cable window-lifter drive including a cable reel in a covered housing. The reel is provided at its end face with drive pins and a coupling component connected to it so as to rotate jointly with a crank bolt engaging between the drive pins. The drive is characterized in that the crank bolt and the coupling component are two separate parts which, in the fully assembled state, are joined by a serration or the like to rotate together. In a pre-assembled condition, only the cable reel, the coupling component and a braking spring are contained in the cable-reel housing. Following installation of the window lifter in the vehicle door, the crank bolt is inserted from the door inner wall into the drive until the serrations at the crank bolt and at the coupling component are aligned.

4 Claims, 2 Drawing Sheets

BOWDEN-CABLE WINDOW-LIFTER DRIVE FOR VEHICLES

BACKGROUND OF THE INVENTION

1. Field of the Invention

The invention concerns a bowden-cable window-lifter drive for automobiles and similar vehicles. More particularly the invention is directed to a bowden-cable window lift wherein the cranking spindle may have any desired length.

2. Description of the Prior Art

An example of a known drive is illustratively disclosed in the German Offenlegungsschrift 33 25 837. In a known manner, such a drive comprises a cable reel inside a housing, with drive pins axially projecting from the end face of the reel. A coupling element integral with a crank bolt enters the and engages the reel between the drive pins. As a rule this crank bolt is an extruded part bearing the cable reel at its end resting in the housing while projecting by its other end through a bottom plate covering the cable reel. This traversing end usually comprises a serration that, following assembly of the window lifter, will receive the actuation crank which is operated by a person.

The window lifter is mounted into the vehicle door by being slipped into the space through the outer skin of the door and the inner wall of the door, whereupon the crank bolt is made to pass by its free end through a hole in the door inner wall. The window lifter together with its driving part and its guide rail is screwed tightly to the door structure in an appropriate manner, preferably to the door inner wall.

To make this assembly possible, the length of the crank bolt must remain below a given value. If the crank bolt is too long, the drive component no longer can be inserted between the outer skin of the door and the inner wall even if slanted, tipped or otherwise twisted. This limit is a functional limit owing to the space available between the inner and outer door skins as well as the size of the gaps provided in the inner door structure.

The limit set on the length of the crank bolt is a substantial drawback because of the ever increasing padding of the door inner wall for increased plushness, safety, and sound deadening, as well as because the new designs of the plug-on crank handles require longer crank bolts. But because a window-lifter drive cannot be installed with such a longer crank bolt, the improvements desired per se to be associated with a longer crank bolt can not be carried out.

SUMMARY OF THE INVENTION

The object of the invention is to overcome the drawbacks of a shortened crank bolt and to provide a bowden-cable window-lifter drive wherein the crank bolt may assume any arbitrary length.

The most essential feature of the drive of the invention is that the crank bolt and the coupling component are two separate parts, of which the coupling component can be slipped onto the crank bolt, and in that the borehole of the coupling component and a circumferential part of the crank bolt assume such complimentary shapes that upon engagement of these two parts they are connected so as to rotate jointly. These complementary shapes for instance may be serrations, or fins at one part entering matching grooves in the other. Any complimentary non-mutually rotatable matching shape is suitable—for instance polygonal shapes too—as long as such shapes allow moving the coupling component and the crank bolt in the axial direction towards one another and in the process joining both parts so they may rotate together.

By means of the parts designed in the manner of the invention, it is possible to preassemble the cable reel, the coupling component and the known brake spring in the cable-reel housing along with the covering bottom plate. The preassemble can then be assembled together with its drive, without the crank bolt, into the door inner surface. Subsequently the crank bolt may be inserted through the door inner wall into the drive. The crank bolt may comprise a collar to limit the depth of insertion to the right value and to rest against the bottom plate in the right position. At the proper depth of insertion of the crank bolt, the complementary shapes of the bolt and of the coupling component engage each other, furthermore the cable reel will be resting on the crank bolt, and lastly the crank bolt will enter a hole in the housing of the cable reel forming the support for the bolt which by its other end rests in the bottom plate.

When so inserted, the crank bolt must be secured against being pulled out. For that purpose the invention proposes to extend the crank bolt beyond the cable-reel housing and to provide an annular clearance in the projecting end to receive a securing ring or an approximately U-bent securing wire or another suitably designed securing means for the inserted crank bolt.

To allow simple disassembly of the crank bolt, the invention further proposes a hole in the securing ring or to provide an externally projecting loop at the securing wire for engagement by a hook-shaped tool to pull out the securing ring or wire. In this manner the crank bolt may be pulled free and a disassembly process accomplished.

The invention is shown in the drawings by means of an illustrative embodiment.

DETAILED DESCRIPTION OF THE DRAWINGS

Figure 1:
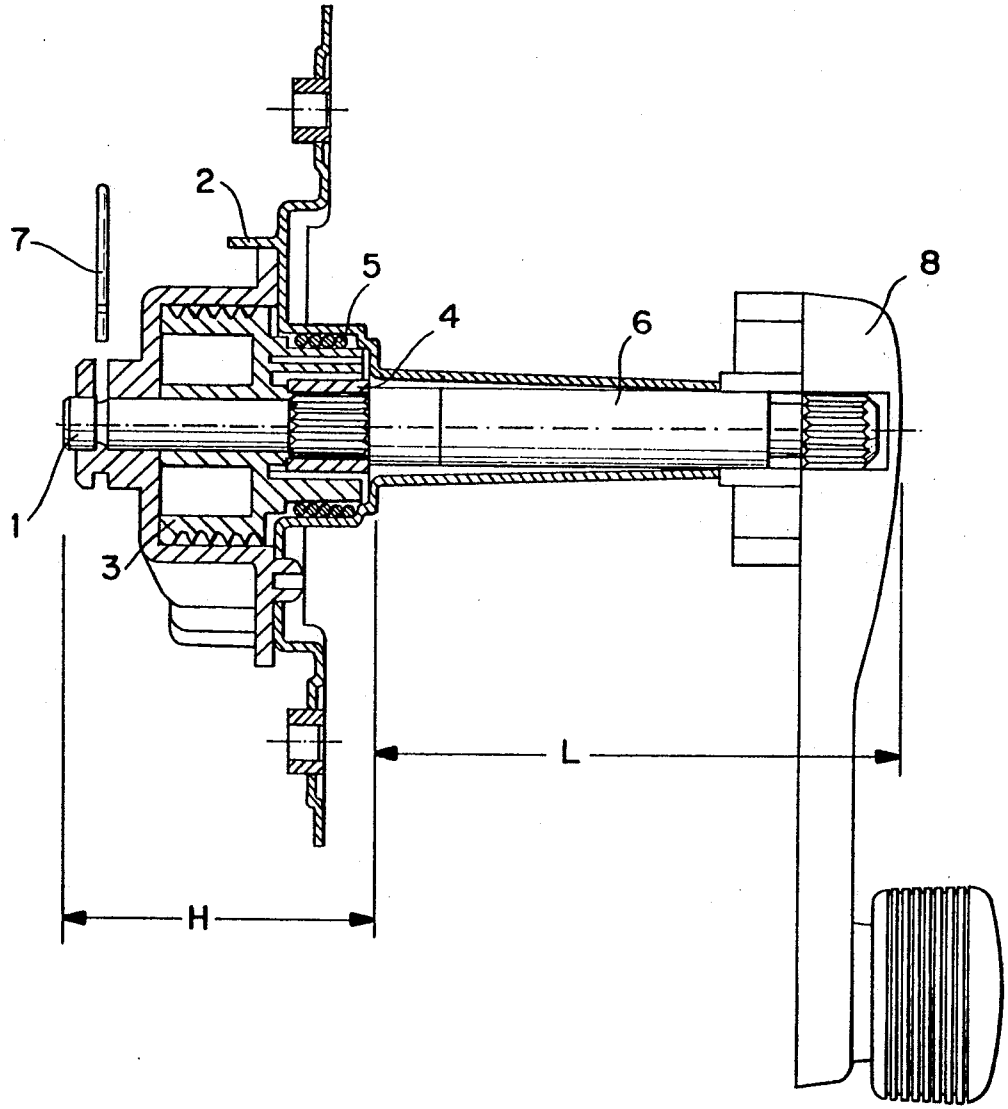
FIG. 1 is an elevational view of the drive of the invention in its pre-assembled state.
Figure 2:
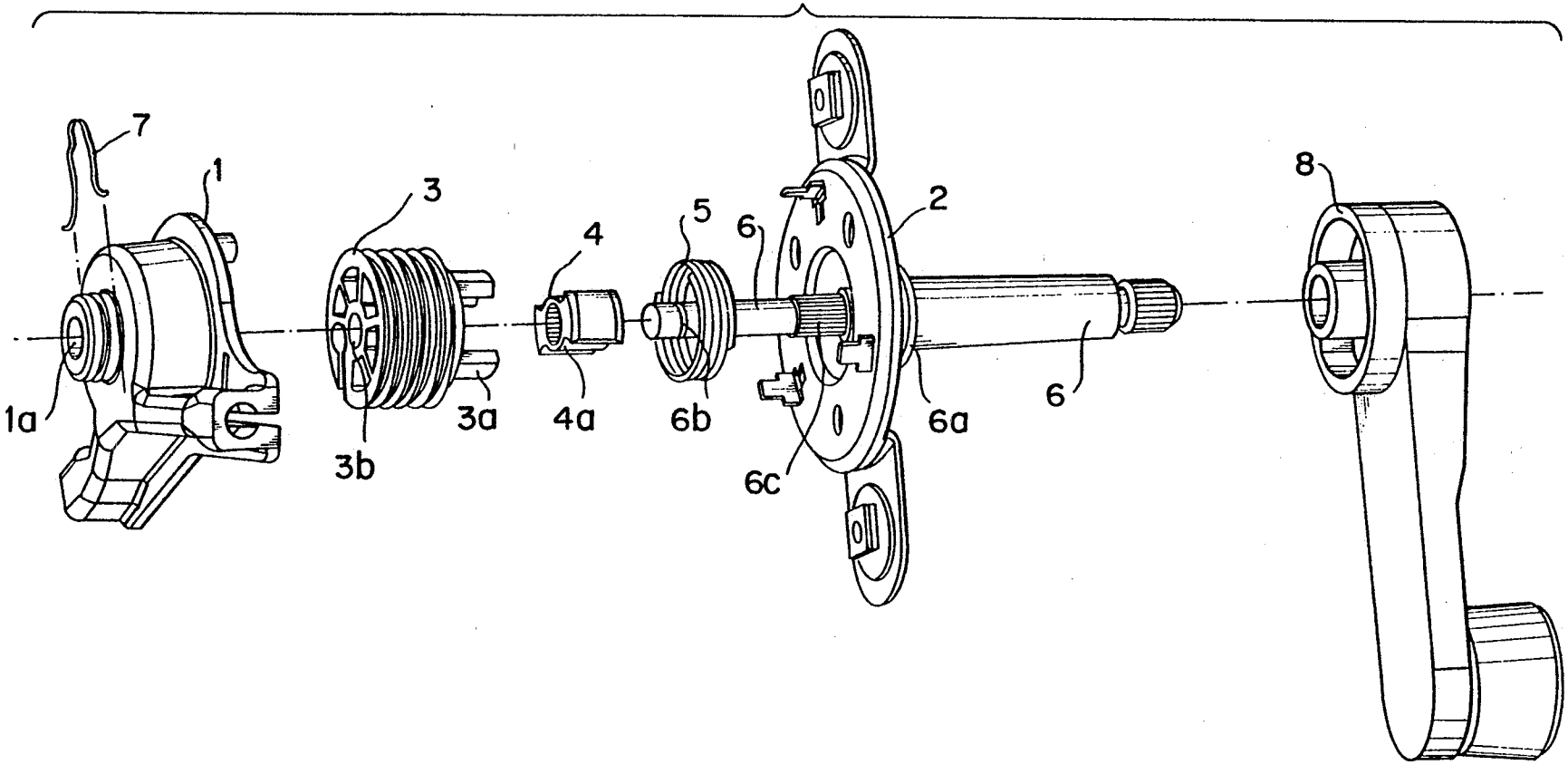
FIG. 2 is an exploded view showing the individual components of the drive.

The figures show the cable-reel housing 1 coupled to a bottom plate 2. The space so defined contains the cable reel 3 which is fitted on one side with the drive pins 3*a*. A coupling component 4 is held between these drive pins 3*a*. In a known manner those parts are enclosed by a braking spring 5.

The cable-reel housing 1 includes a central borehole 1*a*; the cable reel 3 includes a central borehole 3*b* and the coupling component 4 includes a hole 4*a*. The crank bolt 6 is inserted by one end into those boreholes or holes until its collar 6*a* rests against the bottom plate 2. In this position the crank bolt projects beyond the borehole 1*a* wherein an annular clearance 6*b* is provided. This clearance 6*b* receives an approximately U-bent securing wire 7 to prevent the bolt 6 from being pulled out.

In the illustrative embodiment shown, the hole 4*a* of the coupling component 4 between the crank bolt 6 and the window lifter comprises a serration. The crank bolt includes the same serration 6*c* at that site where, in its inserted position, it is aligned with the coupling component 4. Therefore the two parts are linked for common rotation in the inserted crank bolt position. (A discussion already was offered elsewhere that serration is not mandatory. Rather, any complementary shape is sufficient whereby the coupling component and the crank bolt are linked into joint rotation).

In particular FIG. 1 shows furthermore that on account of the division into two parts, i.e. crank bolt and coupling component, a substantial saving in physical height of the drive is achieved. The total physical height now is only H. The length L of the crank bolt 6 is saved. Therefore, it is much easier to insert a bowden-cable window lifter comprising the drive of the invention through the hole in the door inner wall and to assemble it than is the case for corresponding window lifters of the state of the art. Accordingly the padding of the door inner wall also may be much thicker and the crank denoted by 8 can be plugged onto the crank bolt with another, thicker mechanism. To this extent no limit is set anymore on the length of the crank bolt.

What is claimed is:

1. A bowden-cable window-lifter drive, comprising:

a cable reel mounted for rotation in a housing, said cable reel including drive-pins extending from an end face of said cable reel;

coupling means for rotatably driving said cable reel with a crank bolt, said coupling means engaging said drive pins, said coupling means including a coupling component which is a separate part from said crank bolt, said coupling component and crank bolt are joined together through non-circular means for relative axial movement without relative rotary movement therebetween;

said housing including resilient means for retaining said crank bolt on said housing, said resilient means allows relative rotation without relative axial displacement between said crank bolt and said housing;

a bottom plate attached to said housing and generally enclosing said cable reel therewithin, said bottom plate also rotatably supporting said crank bolt;

wherein said crank bolt is axially inserted through said bottom plate and retained on said housing by said resilient means, said non-circular means of said crank bolt and said coupling component engaging each other.

2. A bowden-cable window-lifter drive as in claim 1, wherein:

said resilient means comprises an annular clearance on an end of said crank bolt which is inserted through said bottom plate, said annular clearance receives an elastic securing element attached to said housing.

3. A drive as in claim 1, wherein:

said elastic securing element comprises engagement means that can receive a hooked tool to remove the elastic securing element from said housing.

4. A bowden-cable window-lifter drive comprising:

a housing;

a reel section comprising a cable reel mounted for rotation in said housing and having drive pins mounted on an end face of said reel, a coupling component for connecting with a crank bolt, and engagement means for coupling said coupling component to said cable reel, said reel section being preassembled within said housing;

a bottom plate covering and closing said housing, and forming a rotational support for said crank bolt, said bottom plate being fixed to said housing after said reel section is preassembled;

wherein said crank bolt is axially inserted into said housing after said bottom plate is attached to said housing, said crank bolt being received by said coupling component for rotation therewith.

* * * * *